US011098962B2

(12) United States Patent
Rajani

(10) Patent No.: US 11,098,962 B2
(45) Date of Patent: Aug. 24, 2021

(54) FINLESS HEAT EXCHANGER APPARATUS AND METHODS

(71) Applicant: FORUM US, INC., Houston, TX (US)

(72) Inventor: Hamid Reza Zareie Rajani, Edmonton (CA)

(73) Assignee: FORUM US, INC., Houston, TX (US)

( * ) Notice: Subject to any disclaimer, the term of this patent is extended or adjusted under 35 U.S.C. 154(b) by 198 days.

(21) Appl. No.: 16/282,663

(22) Filed: Feb. 22, 2019

(65) Prior Publication Data

US 2020/0271392 A1 Aug. 27, 2020

(51) Int. Cl.

| | |
|---|---|
| ***F28F 1/02*** | (2006.01) |
| ***F28F 1/06*** | (2006.01) |
| ***F28F 9/02*** | (2006.01) |
| ***F28F 9/00*** | (2006.01) |

(52) U.S. Cl.

CPC ..... *F28F 1/022* (2013.01); *F28F 1/06* (2013.01); *F28F 9/001* (2013.01); *F28F 9/0246* (2013.01); *F28F 2009/0297* (2013.01)

(58) Field of Classification Search

CPC .... F28F 1/006; F28F 1/02; F28F 1/022; F28F 1/025; F28F 1/10; F28F 1/426; F28F 9/0224; F28F 13/02; F28F 2250/02; F28F 9/001; F28F 2009/004; F28F 2275/04; F28F 2275/06; F28F 1/06; F28F 9/04; F28F 9/18; F28D 1/0233; F28D 2001/0266; F28D 2001/0273; F28D 1/0471; F28D 1/0478; F28D 7/1684; F28D 1/0408; F28D 2021/0059

See application file for complete search history.

(56) References Cited

U.S. PATENT DOCUMENTS 1,505,701 A * 8/1924 Cox ..... F28F 1/06 165/148
2,060,848 A 11/1936 Boyle
2,505,999 A 5/1950 Smith
(Continued)

FOREIGN PATENT DOCUMENTS

CA 2415575 A1 1/2002
CA 2963028 A1 4/2016
(Continued)

OTHER PUBLICATIONS

DE-10057240-C1—English machine translation (Year: 2000).*
(Continued)

*Primary Examiner* — Jianying C Atkisson
*Assistant Examiner* — Jose O Class-Quinones
(74) *Attorney, Agent, or Firm* — Patterson + Sheridan, L.L.P.

(57) ABSTRACT

An apparatus and methods are provided for finless heat exchanger cores. A heat exchanger core includes an inlet header and an outlet header. The heat exchanger core also includes one or more curved channel frames disposed at least partially between the inlet header and the outlet header. The one or more curved channel frames have a first end and a second end, and one or more fluid passageways that direct flow of a first fluid in a first direction therethrough from the first end to the second end. In some embodiments, at least one of the one or more curved channel frames includes a rounded leading edge and a tapered trailing edge.

21 Claims, 10 Drawing Sheets

(56) References Cited

U.S. PATENT DOCUMENTS 3,113,634 A 12/1963 Walters
3,207,258 A 9/1965 D'eustachio
3,473,604 A * 10/1969 Tiefenbacher ..... F28F 3/10 165/166
3,572,657 A 3/1971 Bradley, Jr.
3,759,157 A 9/1973 Larkfeldt et al.
3,762,489 A 10/1973 Proksch et al.
3,848,465 A 11/1974 Howell
4,116,269 A 9/1978 Ikeda
4,266,602 A 5/1981 White et al.
4,274,186 A * 6/1981 Pringle ..... B21D 53/027 165/172
4,294,595 A 10/1981 Bowerman
4,332,293 A 6/1982 Hiramatsu
4,348,604 A 9/1982 Thode
4,747,275 A 5/1988 Amr et al.
4,821,828 A 4/1989 Schwerzler et al.
5,213,152 A 5/1993 Cox
5,238,052 A 8/1993 Chagnot
5,482,113 A 1/1996 Agonafer et al.
5,524,607 A 6/1996 Grohman et al.
5,526,871 A 6/1996 Musser et al.
5,879,466 A 3/1999 Creger et al.
5,941,303 A 8/1999 Gowan et al.
6,029,345 A 2/2000 Christensen
6,126,681 A 10/2000 Van Duren et al.
6,129,056 A 10/2000 Skeel et al.
6,151,949 A * 11/2000 Young ..... B21D 15/02 29/890.053
6,199,622 B1 3/2001 Mashio et al.
6,223,812 B1 * 5/2001 Gough ..... F28D 1/05366 165/173
6,240,774 B1 6/2001 Niki et al.
6,286,986 B2 9/2001 Grimland et al.
6,302,197 B1 * 10/2001 Hornby ..... F28D 1/05333 165/153
6,315,487 B1 11/2001 James
6,340,055 B1 * 1/2002 Yamauchi ..... F28D 1/05391 165/153
6,386,273 B1 5/2002 Hateley
6,389,889 B1 5/2002 Ford
6,630,756 B2 10/2003 Kern et al.
6,644,844 B2 11/2003 Neal et al.
6,681,619 B2 1/2004 Alleving et al.
6,736,197 B2 5/2004 Nozaki et al.
6,739,387 B1 * 5/2004 Ren ..... F28D 1/0535 138/38
7,036,568 B2 * 5/2006 Yamauchi ..... F28D 1/0316 165/148
7,210,194 B2 5/2007 Kiem
7,669,485 B2 3/2010 Tang et al.
7,845,413 B2 12/2010 Shampine et al.
7,878,007 B2 2/2011 Campbell et al.
8,188,698 B2 5/2012 Rollins et al.
8,215,833 B2 7/2012 Kouda et al.
8,347,427 B2 1/2013 Klicpera
8,649,931 B2 2/2014 Nishizawa
8,657,227 B1 2/2014 Bayliss et al.
8,764,529 B2 7/2014 Cook et al.
9,103,193 B2 8/2015 Coli et al.
9,109,594 B2 8/2015 Pawlick
9,145,040 B2 9/2015 Markowitz et al.
9,163,880 B2 * 10/2015 Shikazono ..... F28F 1/426
9,250,021 B2 * 2/2016 Kim ..... F28D 7/1623
9,404,417 B2 8/2016 Norrick et al.
9,587,649 B2 3/2017 Oehring
9,945,578 B2 4/2018 Vanberg et al.
9,970,720 B2 5/2018 Vanberg et al.
10,208,983 B2 2/2019 Hjorth et al.
10,281,169 B2 5/2019 Hjorth et al.
2002/0066554 A1 * 6/2002 Oh ..... F28F 1/022 165/179
2002/0074104 A1 6/2002 Dion
2002/0079150 A1 6/2002 Yorwarth et al.
2003/0183446 A1 10/2003 Shah et al.
2003/0217838 A1 * 11/2003 Dey ..... F28F 9/0246 165/173
2004/0035562 A1 * 2/2004 Nishijima ..... F28F 13/06 165/133
2004/0053031 A1 3/2004 Beaufils et al.
2004/0069472 A1 * 4/2004 Shimoya ..... F28F 1/126 165/165
2004/0079521 A1 * 4/2004 Torigoe ..... F28F 21/065 165/166
2004/0177949 A1 * 9/2004 Shimoya ..... F28F 1/126 165/152
2004/0200598 A1 10/2004 Hitt et al.
2005/0159846 A1 7/2005 Van Ostrand et al.
2006/0042276 A1 3/2006 Doll et al.
2007/0023172 A1 2/2007 Obrist et al.
2007/0144720 A1 * 6/2007 Harada ..... F28F 9/0224 165/173
2007/0175620 A1 * 8/2007 Watanabe ..... B23P 15/26 165/173
2008/0017723 A1 1/2008 Johnson et al.
2008/0092587 A1 * 4/2008 Gorbounov ..... F28F 9/185 62/498
2008/0256963 A1 10/2008 Mettier
2010/0028134 A1 2/2010 Slapak et al.
2010/0115771 A1 5/2010 Johnson et al.
2010/0162699 A1 * 7/2010 Dittmann ..... F28D 7/1684 60/605.2
2010/0243220 A1 * 9/2010 Geskes ..... F02M 26/32 165/133
2011/0066298 A1 3/2011 Francino et al.
2011/0162826 A1 * 7/2011 Garret ..... F28F 9/0219 165/157
2011/0192578 A1 8/2011 Lang et al.
2011/0240277 A1 * 10/2011 Westergard ..... F28F 9/02 165/173
2011/0282619 A1 11/2011 Laursen et al.
2012/0111548 A1 * 5/2012 Toparkus ..... F28F 1/02 165/177
2012/0168113 A1 7/2012 Karamanos
2012/0291993 A1 * 11/2012 Concialdi ..... F28D 9/0062 165/104.11
2014/0008074 A1 1/2014 Nevison
2014/0027098 A1 * 1/2014 Alahyari ..... F28F 1/00 165/172
2014/0041840 A1 * 2/2014 Moser ..... F28F 1/08 165/158
2014/0056729 A1 2/2014 Pawlick
2014/0260178 A1 * 9/2014 Eleftheriou ..... F02C 7/08 60/39.511
2014/0262147 A1 9/2014 Pawlick
2014/0365195 A1 12/2014 Lahiri et al.
2015/0047811 A1 2/2015 Kappelman et al.
2015/0070007 A1 3/2015 Kumiawan
2015/0251521 A1 9/2015 Brauer et al.
2015/0252661 A1 9/2015 Glass
2015/0343892 A1 12/2015 Kolhouse et al.
2015/0362207 A1 12/2015 Abiprojo et al.
2016/0018167 A1 * 1/2016 Dziubinschi ..... F28F 3/044 165/177
2016/0146487 A1 5/2016 Zywiak et al.
2016/0146551 A1 * 5/2016 Kolb ..... F28D 1/0417 165/173
2016/0186649 A1 6/2016 Rollinger et al.
2016/0305865 A1 10/2016 Silva et al.
2017/0010054 A1 * 1/2017 Citti ..... F28F 9/0229
2017/0016649 A1 1/2017 Ace
2017/0096885 A1 4/2017 Oehring et al.
2017/0234631 A1 8/2017 Anderl et al.
2017/0292735 A1 10/2017 Hjorth et al.
2017/0292736 A1 10/2017 Hjorth et al.
2017/0292789 A1 10/2017 Hjorth et al.
2017/0292800 A1 10/2017 Vanberg et al.
2017/0292801 A1 10/2017 Vanberg et al.
2017/0292803 A1 10/2017 Vanberg et al.
2017/0294103 A1 10/2017 Vanberg et al.
2017/0294366 A1 10/2017 Vanberg et al.

(56) References Cited

U.S. PATENT DOCUMENTS

| | | | | |
|---|---|---|---|---|
| 2018/0003532 | A1 | 1/2018 | Vanberg et al. | |
| 2018/0209752 | A1 | 7/2018 | Vanberg et al. | |
| 2018/0209827 | A1 | 7/2018 | Vanberg et al. | |
| 2019/0049186 | A1* | 2/2019 | Yoshimura | F25B 39/00 |

FOREIGN PATENT DOCUMENTS

| | | | | |
|---|---|---|---|---|
| DE | 10057240 | C1 * | 4/2002 | F28F 1/02 |
| DE | 10306786 | A1 | 8/2003 | |
| DE | 102007023361 | A1 * | 11/2008 | B21C 37/225 |
| WO | WO-0216834 | A2 * | 2/2002 | F28F 1/22 |
| WO | 2016079674 | A1 | 5/2016 | |

OTHER PUBLICATIONS

DE-102007023361-A1—English machine translation (Year: 2008).*
Enerflow 3512 frac truck brochure, L&M Radiator Inc., copyright notice dated 2011 (2 pgs).
World Academy of Science, Engineering and Technology, vol. 6 Nov. 28, 2012, "CFD Modeling of a Radiator Axial Fan for Air Flow Distribution", date of publication indicated as 2012 (6 pgs).
Canadian Office Action dated Jul. 6, 2018 for Application No. 2,963,572.
Canadian Office Action dated Apr. 26, 2018 for Application No. 2,963,568.
Canadian Office Action dated Feb. 8, 2019 for Application No. 2,969,703.
Canadian Office Action dated Jul. 25, 2018 for Application No. 2,971,746.
Canadian Office Action dated Oct. 12, 2018 for Application No. 2,979,845.
Canadian Office Action dated Nov. 15, 2018 for Application No. 3,022,969.
Canadian Office Action dated Feb. 12, 2019 for Application No. 3,030,718.
International Search Report and Written Opinion dated Jul. 5, 2018 for Application No. PCT/IB2018/052269.
International Search Report and Written Opinion dated Dec. 17, 2018 for Application No. PCT/IB2018/057065.

* cited by examiner

FINLESS HEAT EXCHANGER APPARATUS AND METHODS

BACKGROUND

Field

The present disclosure relates to heat exchangers and components thereof.

Description of the Related Art

Heat exchangers are used in many applications, including but not limited to the oil and gas industry. Operators seek to increase the thermal efficiency of heat exchangers. Attempts to increase efficiency have included placing fins in the fluid flow paths of heat exchangers. However, fins at least partially block the flow paths, causing a build-up of debris that can decrease thermal efficiency and cause equipment to overheat. The fins also make it harder to clean the flow paths. Moreover, these fins often contribute to a pressure drop in the fluid flowing in such flow paths, sometimes requiring more power to pressurize the fluid. Fins are also prone to damage during shipping, installation, and operation. These issues negatively affect the thermal efficiency of a heat exchanger and can lead to increased operational costs and lost operating time due to shut down periods.

Heat exchangers also commonly fail because of their structural integrity. That is, welding components of the heat exchanger involve complicated process control procedures to ensure that the welding does not damage or affect other joints in the heat exchanger. Such process control procedures are often overlooked or are not accurately followed. As a result, many heat exchangers have joints that are damaged or affected as a result of the welding process, causing failures.

Therefore, there is a need for an improved heat exchanger that reliably increases thermal efficiencies at a reduced input power.

SUMMARY

The present disclosure relates to finless heat exchangers and components thereof.

In one or more embodiments, a finless heat exchanger core includes an inlet header and an outlet header. The heat exchanger core also includes one or more curved channel frames disposed at least partially between the inlet header and the outlet header. The one or more curved channel frames have a first end and a second end, and one or more fluid passageways that direct flow of a first fluid in a first direction therethrough from the first end to the second end. In some embodiments, at least one of the one or more curved channel frames includes a rounded leading edge and a tapered trailing edge.

In one or more embodiments, a finless heat exchanger core includes an inlet header and an outlet header. The heat exchanger core also includes one or more curved channel frames disposed at least partially between the inlet header and the outlet header. The one or more curved channel frames have a first end and a second end, and one or more fluid passageways that direct flow of a first fluid in a first direction therethrough from the first end to the second end. In some embodiments, at least one of the one or more curved channel frames has a cross section and a first length defined between the inlet header and the outlet header. In some embodiments, the cross section is curved and substantially continuous throughout the first length.

In one or more embodiments, a finless heat exchanger core includes one or more channel frames. The one or more channel frames have a first end, a second end, an inlet portion adjacent to the first end, and an outlet portion adjacent to the second end. The heat exchanger core also includes an inlet tank that includes an inlet header disposed around the inlet portion of the one or more channel frames, and an inlet cover welded to the inlet header, thereby defining a first welded joint. The heat exchanger further includes an outlet tank that includes an outlet header disposed around the outlet portion of the one or more channel frames, and an outlet cover welded to the outlet header, thereby defining a second welded joint.

In one or more embodiments, a method of manufacturing a heat exchanger core includes forming one or more channel frames, where the one or more channel frames have a first end, a second end, an inlet portion adjacent to the first end, and an outlet portion adjacent to the second end. The method also includes disposing the one or more channel frames into an inlet header and an outlet header such that the first end of each of the one or more channel frames is received in a corresponding opening in the inlet header, and the second end of the one or more channel frames is received in a corresponding opening in the outlet header. Additionally, the method includes brazing the one or more channel frames to the inlet header and the outlet header, thereby forming a first set of one or more brazed joints adjacent to the inlet header and a second set of one or more brazed joints adjacent to the outlet header. The method further includes welding an inlet cover to the inlet header, thereby forming an inlet tank that defines an inlet volume. The method also includes welding an outlet cover to the outlet header, thereby forming an outlet tank that defines an outlet volume.

BRIEF DESCRIPTION OF THE DRAWINGS

So that the manner in which the above-recited features of the disclosure can be understood in detail, a more particular description of the disclosure, briefly summarized above, may be had by reference to embodiments, some of which are illustrated in the appended drawings. It is to be noted, however, that the appended drawings illustrate only embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
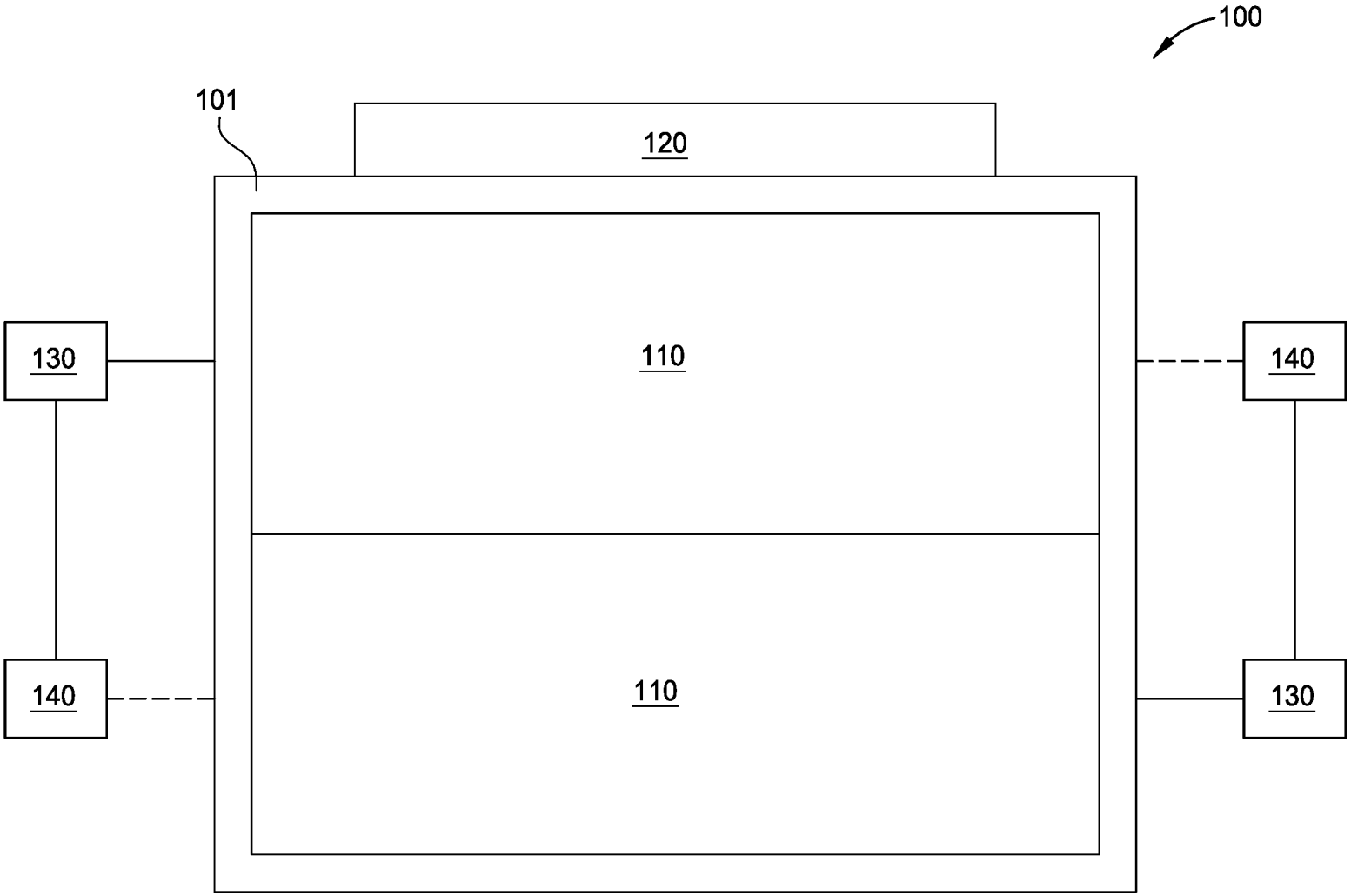
FIG. 1 is a front-view schematic illustration of a heat exchanger unit, according to one embodiment.

FIG. 1 illustrates a heat exchanger unit 100. The heat exchanger unit 100 may include one or more heat exchanger cores 110. The heat exchanger unit 100 may also be coupled to one or more fluid circuits 130, that supply fluids to and return fluids from the heat exchanger unit 100, such fluids including, but not limited to, air, refrigerants, engine coolant, transmission fluid, glycol, fluid lubricants, oil, or water. The present disclosure contemplates that the term "coupled," as used herein, includes direct and/or indirect coupling. One or more fluid movers 140, such as pumps or engines, can be used to supply and/or return a first fluid to and from the heat exchanger unit 100. The heat exchanger core 110 can have a width of about 2 feet, a height of about 2 feet, and a depth of about 6 inches. The present disclosure contemplates that the dimensions of the heat exchanger core 110 can be larger or smaller than those recited herein.

The heat exchanger unit 100 includes at least one fluid mover 120 (such as a pump, fan, or engine) for directing a second fluid, including but not limited to air, through the heat exchanger cores 110. In some embodiments, the heat exchanger unit 100 flows the first fluid in a first direction that is perpendicular to a second direction in which the second fluid flows. In the embodiment illustrated in FIG. 1, the heat exchanger unit 100 includes two heat exchanger cores 110 coupled to a housing 101 of the heat exchanger unit 100. In some embodiments, one or more heat exchanger cores 110 may be disposed on other faces of the heat exchanger unit 100. Moreover, one or more heat exchanger cores 110 may be disposed on the inside of the heat exchanger unit 100, or behind the heat exchanger cores 110 that are disposed on the housing 101 of the heat exchanger unit 100. In accordance with the present disclosure, those of ordinary skill in the art appreciate that the number of heat exchanger cores 110 used in any given heat exchanger unit 100 may vary, and that the heat exchanger cores 110 may be disposed in various locations on and/or within a given heat exchanger unit 100.

The heat exchanger cores 110 may also be configured in different orientations such that fluid passageways therein are disposed in different orientations. In one example, the heat exchanger cores 110 are aligned such that a longitudinal direction of one or more fluid passageways therein are aligned with a direction of fluid moved by the fluid mover 120. Aligning the fluid passageways with a direction of fluid can reduce pressure drop across the heat exchanger unit 100 and increase an efficiency of the heat exchanger unit 100.

Figure 2:
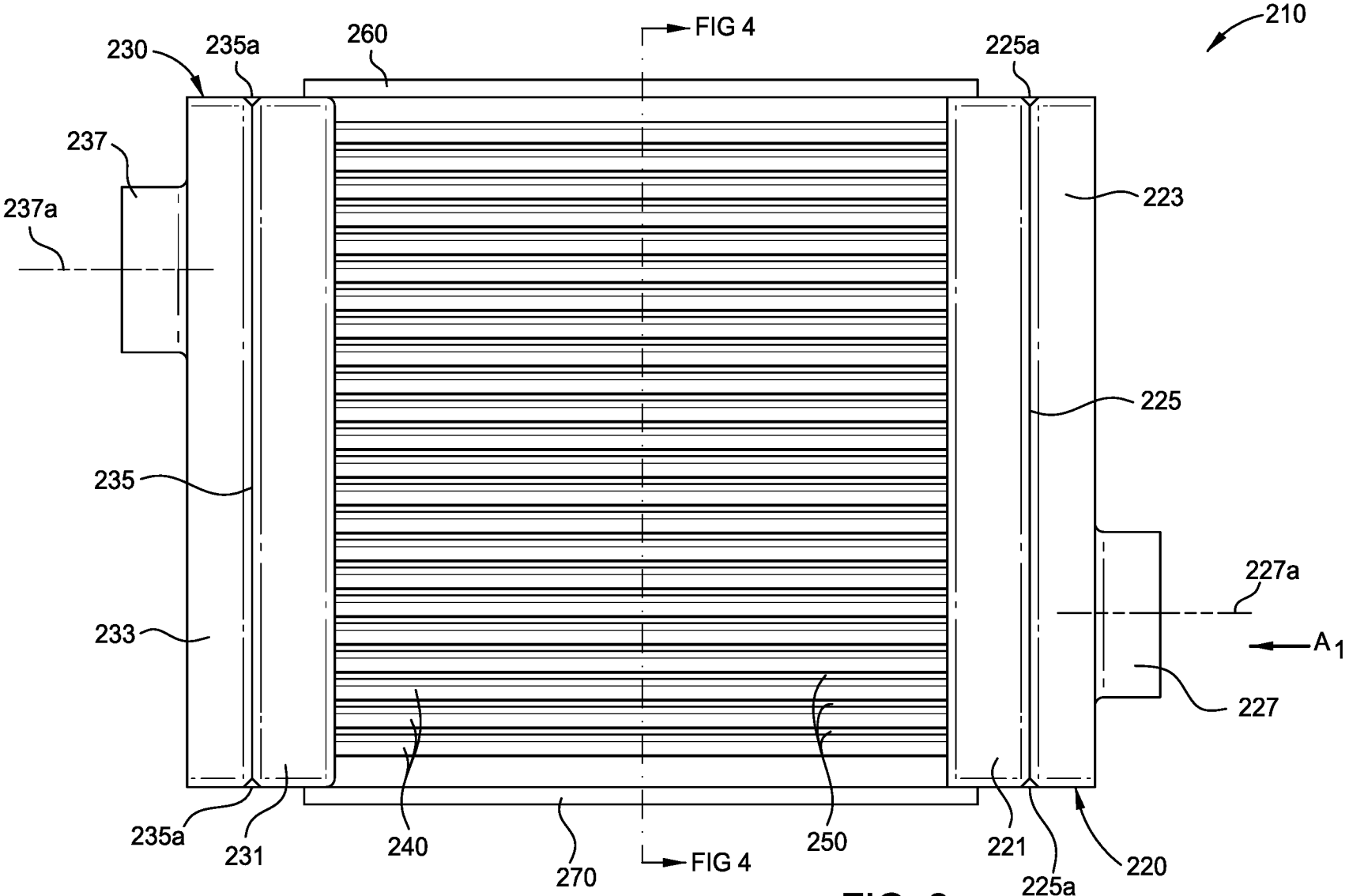
FIG. 2 is a front-view schematic illustration of a heat exchanger core, according to one embodiment.

FIG. 2 illustrates a finless heat exchanger core 210, the aspects of which may be used in one or more of the heat exchanger cores 110 illustrated in FIG. 1. The finless heat exchanger core 210 includes an inlet tank 220 and an outlet tank 230. The inlet tank 220 includes an inlet header 221 and an inlet cover 223. The outlet tank 230 includes an outlet header 231 and an outlet cover 233.

The inlet tank 220 also includes an inlet tube 227. The inlet tube 227 can be coupled to or formed as a single body with the inlet cover 223 of the inlet tank 220. In some embodiments, the inlet tube 227 is welded to the inlet cover 223 of the inlet tank 220. The outlet tank 230 includes an outlet tube 237. The outlet tube 237 can be coupled to or formed as a single body with the outlet cover 233 of the outlet tank 230. In some embodiments, the outlet tube 237 is welded to the outlet cover 233 of the outlet tank 230. The inlet tube 227 defines an axis 227*a* and the outlet tube 237 defines an axis 237*a*. In some embodiments, the axis 227*a* of the inlet tube 227 and the axis 237*a* of the outlet tube 237 are not axially aligned with each other. In some embodiments, the axis 227*a* of the inlet tube 227 and the axis 237*a* of the outlet tube 237 are axially aligned with each other. The axis 227*a* of the inlet tube 227 may be disposed below the axis 237*a* of the outlet tube 237, as illustrated in FIG. 2, or the axis 227*a* of the inlet tube 227 may be disposed above the axis 237*a* of the outlet tube 237.

The inlet header 221 and the inlet cover 223 may be coupled to each other or formed a single body of the inlet tank 220. In some embodiments, the inlet header 221 and the inlet cover 223 are welded to each other, thereby defining a first welded joint 225. In some embodiments, the inlet tank 220 includes a first welded material 225*a*. The inlet header 221 and the inlet cover 223 define an inlet volume (e.g. inlet volume 520 shown in FIG. 5A).

The outlet header 231 and the outlet cover 233 may be coupled to each other or formed as a single body of the outlet tank 230. In some embodiments, the outlet header 231 and the outlet cover 233 are welded to each other, thereby defining a second welded joint 235. In some embodiments, the outlet tank 230 includes a second welded material 235*a*. In some embodiments the first welded material 225*a* and the second welded material 235*a* comprise the same material. The outlet header 231 and the outlet cover 233 define an outlet volume (e.g. outlet volume 530 shown in FIG. 5A).

The heat exchanger core 210 includes one or more curved channel frames 240 disposed at least partially between the inlet header 221 of the inlet tank 220 and the outlet header 231 of the outlet tank 230. The curved channel frames 240 are spaced from one another such that they form one or more gaps 250 between adjacent curved channel frames 240. The heat exchanger core 210 includes a first plate 260 and a second plate 270. The curved channel frames 240 may be coupled to or formed as a single body with the inlet header 221 of the inlet tank 220 and/or the outlet header 231 of the outlet tank 230.

The inlet tube 227 and the outlet tube 237 may be fluidly coupled to one or more fluid circuits 130 (illustrated in FIG. 1) that flow fluids therethrough. The fluids flowing through the fluid circuits 130 may include, but are not limited to, air, refrigerants, engine coolant, transmission fluid, glycol, fluid lubricants, oil, or water. One or more fluid movers 140 (illustrated in FIG. 1), such as pumps, compressors, or fans, may be configured to flow the fluids through the fluid circuits 130.

The curved channel frames 240 may include one or more louvers 280 that can increase the thermal efficiency of the heat exchanger core 210 by introducing turbulence into the flow of the second fluid flowing in the second direction $B_1$. The louvers 280 can also increase the thermal efficiency by increasing surface areas of the curved channel frames 240 for exchanging heat with the second fluid. The louvers 280 can be straight or curved. In one example, the louvers 280 are micro grooves. The louvers 280 can be machined, printed using 3-D printing, casted, or brazed.

The various components and aspects (including but not limited to components 220, 221, 223, 225, 227, 230, 231, 233, 235, 237, 240, 260, 270, and 280) of the heat exchanger core 210 illustrated may be made from a material that comprises one or more materials which include but are not limited to: metal, aluminium, copper, steel, titanium, plastics, polymeric materials, polyamide (nylon), composites, ceramics, and/or polytetrafluoroethylene (PTFE). The various components and aspects (including but not limited to components 220, 221, 223, 225, 227, 230, 231, 233, 235, 237, 240, 260, 270, and 280) of the heat exchanger core 210 may be made with manufacturing methods that include but are not limited to: machining, extruding, stamping, casting, welding, brazing, forging, and/or methods involving additive manufacturing.

Figure 3:
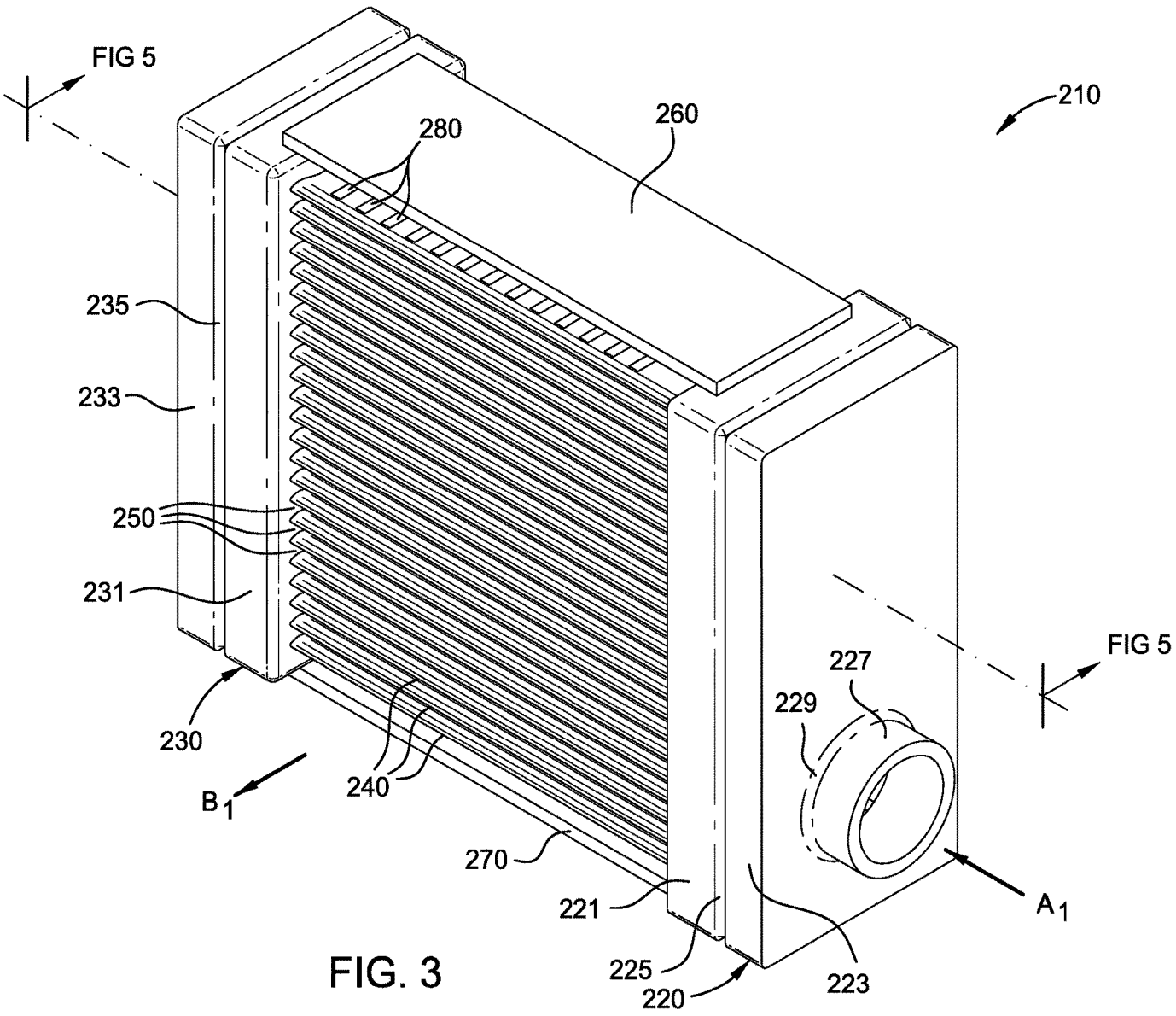
FIG. 3 is an isometric schematic illustration of the heat exchanger core, according to one embodiment.

FIG. 3 is an isometric schematic illustration of the heat exchanger core 210 illustrated in FIG. 2. The curved channel frames 240 have one or more fluid passageways (e.g. fluid passageways 410 shown in FIGS. 4A and 4B) that direct flow of a first fluid in a first direction $A_1$ therethrough. One or more fluid movers 140 (illustrated in FIG. 1), such as pumps, compressors, or fans, may be configured to flow the first fluid in the first direction $A_1$. One or more fluid movers, such as pumps, compressors, or fans, may be configured to flow a second fluid in a second direction $B_1$. In some embodiments, the first direction $A_1$ is perpendicular to the second direction $B_1$.

The curved channel frames 240 are spaced from each other such that they form one or more gaps 250. In some embodiments, the heat exchanger core 210 is configured such that the second fluid is configured to flow in the gaps 250 between the curved channel frames 240. The first fluid and the second fluid may include, but are not limited to, one or more of the following: air, refrigerants, engine coolant, transmission fluid, glycol, fluid lubricants, oil, or water. One or more fluid movers, such as pumps, compressors, or fans, may be configured to flow the second fluid through the gaps 250.

In some embodiments, the first fluid flowing in the first direction $A_1$ is water and the second fluid flowing in the second direction $B_1$ air. The first fluid may flow at a first temperature. The second fluid may flow at a second temperature. In some embodiments, the first temperature of the first fluid is higher than the second temperature of the second fluid. In some embodiments, the first temperature of the first fluid is lower than the second temperature of the second fluid.

Figure 4A:
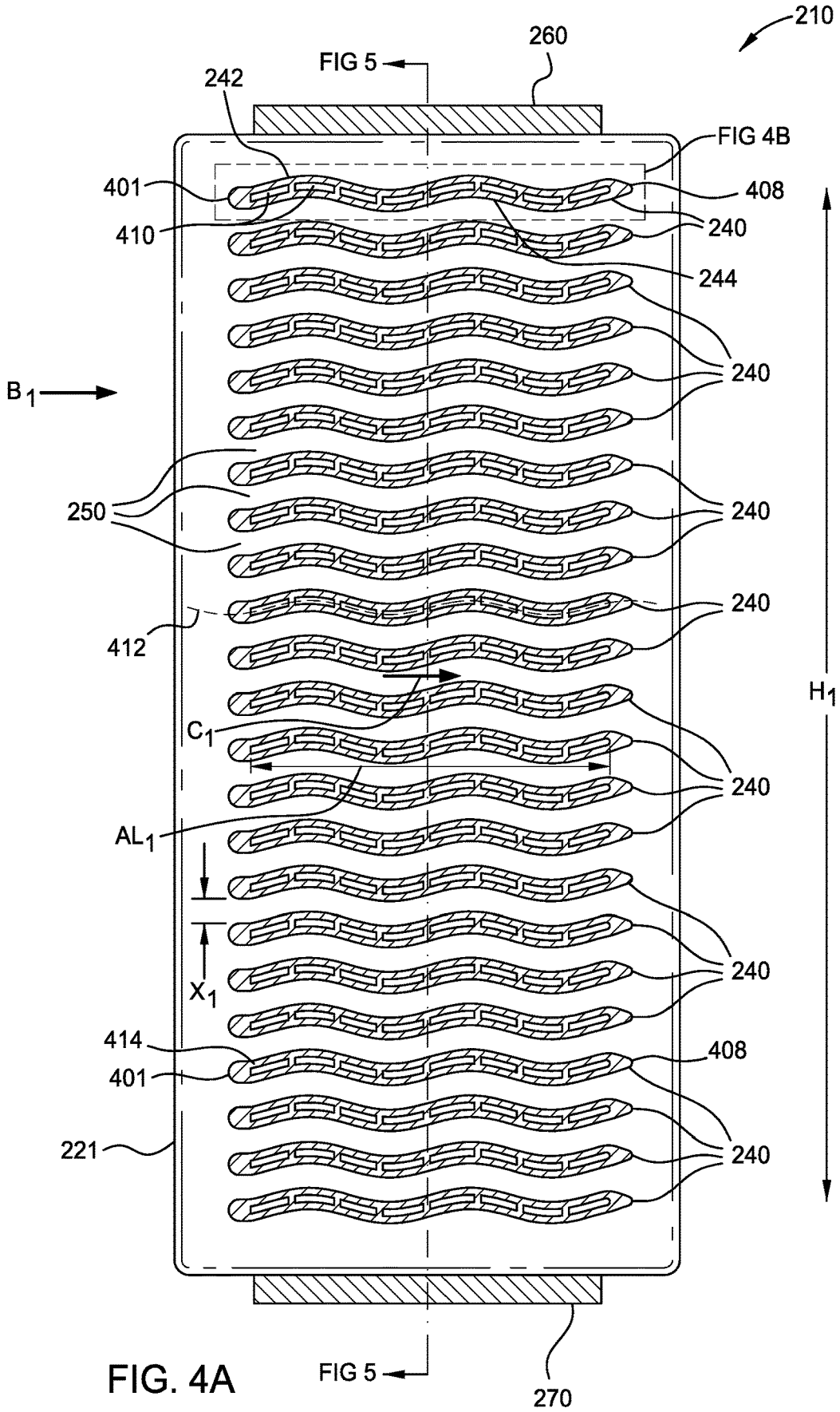
FIG. 4A is a cross-sectional schematic illustration of the heat exchanger core taken along section 4-4 in FIG. 2, according to one embodiment.

FIG. 4A is a cross-sectional schematic illustration of the heat exchanger core 210, taken along section 4-4 in FIG. 2. The curved channel frames 240 are spaced from one another such that they form one or more gaps 250. The curved channel frames 240 may be made up of single bodies, or may comprise multiple pieces. One or more of the curved channel frames include a leading edge 401 and a trailing edge 408. In some embodiments, the leading edge 401 is rounded. In some embodiments, the trailing edge 408 is tapered. In some embodiments, each of the one or more curved channel frames 240 includes a rounded leading edge 401 and a tapered trailing edge 408. The curved channel frames 240 include one or more fluid passageways 410. The fluid passageways 410 are configured to direct flow of the first fluid therethrough in the first direction $A_1$ (shown in FIGS. 2 and 3). In some embodiments, at least one of the one or more curved channel frames 240 defines a curved profile 412 in a direction $C_1$ that is perpendicular to the first direction $A_1$ (shown in FIGS. 2 and 3). A second fluid flows through the heat exchanger core 210 in the second direction $B_1$. The second fluid flows past one or more leading edges 401 of one or more curved channel frames 240, through the gaps 250, and past one or more trailing edges 408. One or more of the curved channel frames 240 has a cross section 414. The cross section 414 is curved.

The gaps 250 act as flow paths for the second fluid flowing in the second direction $B_1$. The second fluid flowing in the second direction $B_1$, through the gaps 250, can exchange heat with the first fluid flowing in the first direction (shown as $A_1$ in FIGS. 2 and 3) through the one or more fluid passageways 410. The curved profile 412 of at least one of the one or more curved channel frames 240 can increase thermal efficiencies of the heat exchanger core 210 by increasing the outer surface area of at least one of the curved channel frames 240. For example, the curved profile 412 can increase the surface area of an upper surface 242 and a lower surface 244 (discussed below in reference to FIG. 4B) that contacts the second fluid flowing in the second direction $B_1$. As another example, the gaps 250 can enhance thermal efficiencies because the second fluid can freely flow in the second direction $B_1$ therethrough. These benefits can be achieved without blocking the gaps 250 with a component, such as a fin, that would cause debris to build up in the gaps 250 and/or make it more difficult to clean the gaps 250. These benefits can also be achieved without blocking the gaps 250 with a component, such as a fin, that is prone to damage, or a material that adds components which are coupled to components of the heat exchanger core 210 by processes such as brazing or welding. By reducing the number of components that are coupled together, the heat exchanger core 210 is less prone to failure because coupling components together can cause failures at the coupling points.

In some embodiments, the one or more fluid passageways 410 of the one or more curved channel frames 240 are configured to withstand a temperature of the first fluid that is within a range of about −50 degrees Celsius to about 300 degrees Celsius. For example, in some embodiments the fluid passageways 410 are configured to withstand a temperature of the first fluid that is that is within a range of about 20 degrees Celsius to about 150 degrees Celsius. In some embodiments, the fluid passageways 410 are configured to withstand a temperature of the first fluid that is about 120 degrees Celsius. In some embodiments, the one or more fluid passageways 410 of the one or more curved channel frames 240 are configured to withstand a pressure of the first fluid that is within a range of about 0 psi to about 700 psi. For example, in some embodiments the fluid passageways 410 are configured to withstand a pressure of the first fluid that is within a range of about 0 psi to about 200 psi. In some embodiments, the fluid passageways 410 are configured to withstand a pressure of the first fluid that is about 60 psi. In some embodiments, the fluid passageways 410 are curved.

In some embodiments, at least two of the curved channel frames 240 are spaced from each other at a distance $X_1$. In some embodiments, the distance $X_1$ is within a range of about 1 mm to about 30 mm. For example, in some embodiments the distance $X_1$ is within a range of about 2 mm to about 10 mm. In some embodiments, the distance $X_1$ is about 3 mm. In some embodiments, at least two of the channel frames are spaced such that distance $X_1$ occurs throughout an axial length $AL_1$ measured between the leading edges 401 and the trailing edges 408 of the curved channel frames 240. The curved channel frames 240 are disposed at a frame density along a length $H_1$. The frame density is defined by a number of curved channel frames 240 per inch along the length $H_1$. In one example, the frame density is within a range of about 0.5 curved channel frames per inch to about 6 curved channel frames per inch. In one example, the frame density is within a range of about 2 curved channel frames per inch to about 5 curved channel frames per inch. In one example, the frame density is about 4 to 4.5 curved channel frames per inch.

By using a frame density and/or a distance $X_1$ between the curved channel frames 240, heat transfer between the first fluid flowing in the first direction $A_1$ (shown in FIGS. 2 and 3) and the second fluid flowing in the second direction $B_1$ is efficiently increased. For example, these aspects can increase a heat exchange rate between the first fluid flowing in the first direction $A_1$ and the second fluid flowing in the second direction $B_1$. The distance $X_1$ and/or the frame density can increase the total amount of surface area at which the curved channel frames 240 contacts the first fluid flowing in the first direction $A_1$. The distance $X_1$ and/or the frame density can also increase the total amount of surface area at which the curved channel frames 240 contacts the second fluid flowing in the second direction $B_1$. The distance $X_1$ and/or the frame density can also increase and/or decrease respective velocities of the first fluid and the second fluid, which leads to increased heat exchange rates between the first fluid and the second fluid. For example, decreasing distance $X_1$ and/or increasing the frame density would increase the velocity of the second fluid flowing in the second direction $B_1$ through the gaps 250, and/or would decrease the velocity of the first fluid flowing in the first direction $A_1$ through the fluid passageways 410.

Figure 4B:
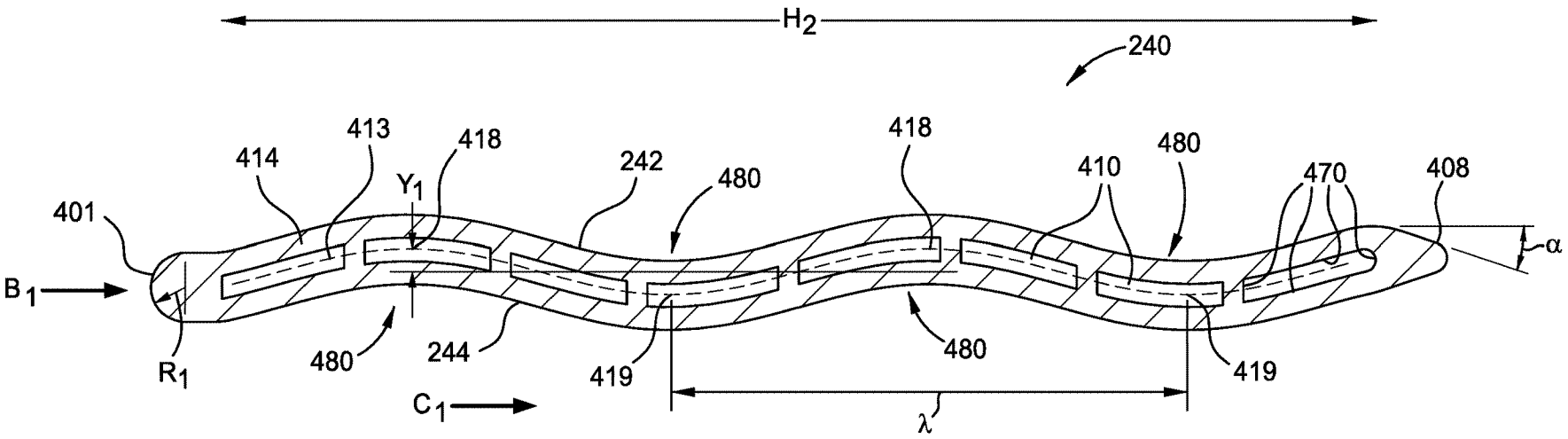
FIG. 4B is an enlarged view of part of FIG. 4A.

FIG. 4B is a partially-enlarged schematic view of part of FIG. 4A. The fluid passageways 410 of the curved channel frame 240 act as flow paths for the first fluid flowing in the first direction $A_1$. The first fluid flowing in the first direction (shown as $A_1$ in FIGS. 2 and 3) through the fluid passageways 410 can exchange heat with the second fluid flowing in the second direction $B_1$. The curved channel frame 240 includes one or more inner walls 470. At least one of the inner walls 470 may be curved (as shown in FIG. 4B).

The curved configuration of at least one of the inner walls 470 can increase thermal efficiencies of the heat exchanger core 210 by increasing the inner surface area of at least one of the fluid passageways 410. For example, the curved configuration of an inner wall 470 can increase the surface area of a fluid passageway 410 that contacts the first fluid flowing in the first direction $A_1$. As another example, the fluid passageways 410 can enhance thermal efficiencies because the first fluid can freely flow in the first direction $A_1$ therethrough. These benefits can be achieved without blocking the fluid passageways 410 with a component, such as a fin, that would cause debris to build up in the fluid passageways 410 and/or make it more difficult to clean the fluid passageways 410. These benefits can also be achieved without blocking the fluid passageways 410 with a component, such as a fin, that is prone to damage.

Referring to FIG. 4B, the leading edge 401 of the curved channel frame 240 is rounded. The trailing edge 408 of the curved channel frame 240 is tapered. The rounded leading edge 401 defines a radius $R_1$. In some embodiments, the radius $R_1$ is within a range of about 1 mm to about 4 mm. For example, in some embodiments the radius $R_1$ is within a range of about 1 mm to about 3 mm. In some embodiments, the radius $R_1$ is about 1.5 mm. The tapered trailing edge 408 defines a taper angle $\alpha$. In some embodiments, the taper angle $\alpha$ is within a range of about 10 degrees to about 60 degrees. For example, in some embodiments the taper angle $\alpha$ is within a range of about 20 degrees to about 45 degrees. In some embodiments, the taper angle $\alpha$ is about 35 degrees.

The rounded configuration of the leading edge 401 reduces a build-up of dirt and/or debris near the leading edge 401 of the curved channel frame 240. The rounded configuration of the leading edge 401 also increases the heat exchange rate of the heat exchanger core 210 by introducing turbulence into the flow of the second fluid flowing in the second direction $B_1$. The tapered configuration of the trailing edge 408 reduces the pressure drop of the second fluid flowing in the second direction $B_1$ between the leading edge 401 and the trailing edge 408. The tapered configuration of the trailing edge 408 hence increases efficiencies by reducing the power used to flow the second fluid in the second direction $B_1$.

In some embodiments, the curved channel frame 240 defines a sinusoidal profile 413 having one or more waves. The sinusoidal profile 413 includes one or more crests 418 and one or more troughs 419. The crests 418 and troughs 419 are disposed at a peak density along a length $H_2$. The peak density is defined by a number of peaks (including one or more crests 418 and one or more troughs 419) per inch along the length $H_2$. In one example, the peak density is within a range of about 1 peak per inch to about 8 peaks per inch. In one example, the peak density is about 2 peaks per inch. The sinusoidal profile 413 has an amplitude $Y_1$ and a wavelength $\lambda$. In some embodiments, the amplitude $Y_1$ is within a range of about 1 mm to about 10 mm. In one example, the amplitude $Y_1$ is about 3 mm. In some embodiments, the wavelength $\lambda$ is within a range of about 0.25 inches to about 2 inches. In one example, the wavelength $\lambda$ is about 1 inch. The curved channel frame 240 includes an upper surface 242 and a lower surface 244 that correspond to the sinusoidal profile 413. The curved configurations of the upper surface 242 and the lower surface 244 (shown in FIG. 4B) allow for one or more recesses 480 on the curved channel frame 240. The one or more recesses 480 can introduce turbulence into the flow of the second fluid flowing in the second direction $B_1$. Introduction of turbulence into the flow of the second fluid enhances the heat exchange rate between the first fluid flowing in the first direction $A_1$ and the second fluid flowing in the second direction $B_1$. Enhancing the heat exchange rate between these fluid flows can enhance thermal efficiencies of the heat exchanger core 210.

Figure 5A:
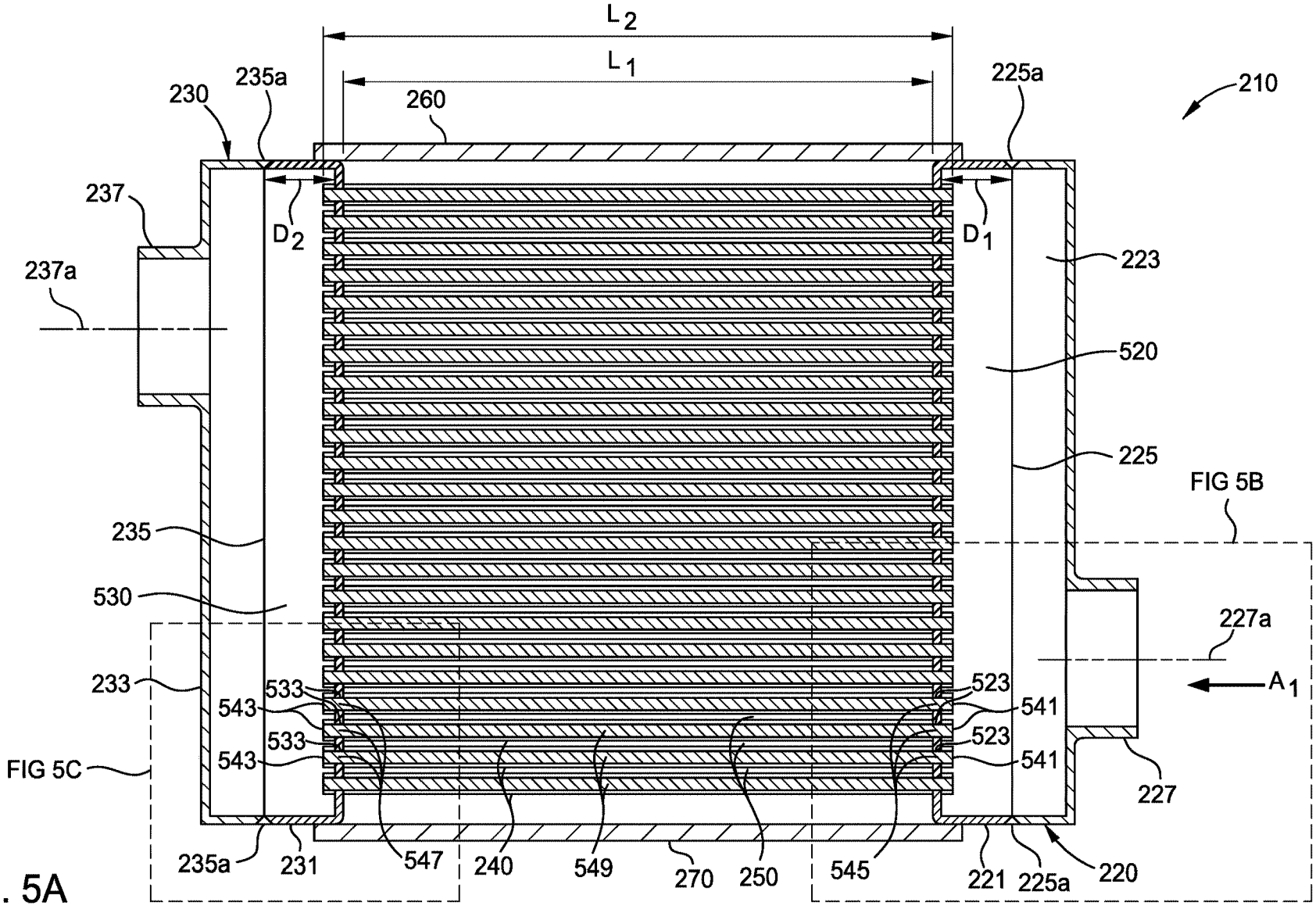
FIG. 5A is a cross-sectional schematic illustration of the heat exchanger core taken along section 5-5 shown in FIG. 3 and FIG. 4A, according to one embodiment.
Figure 5B:
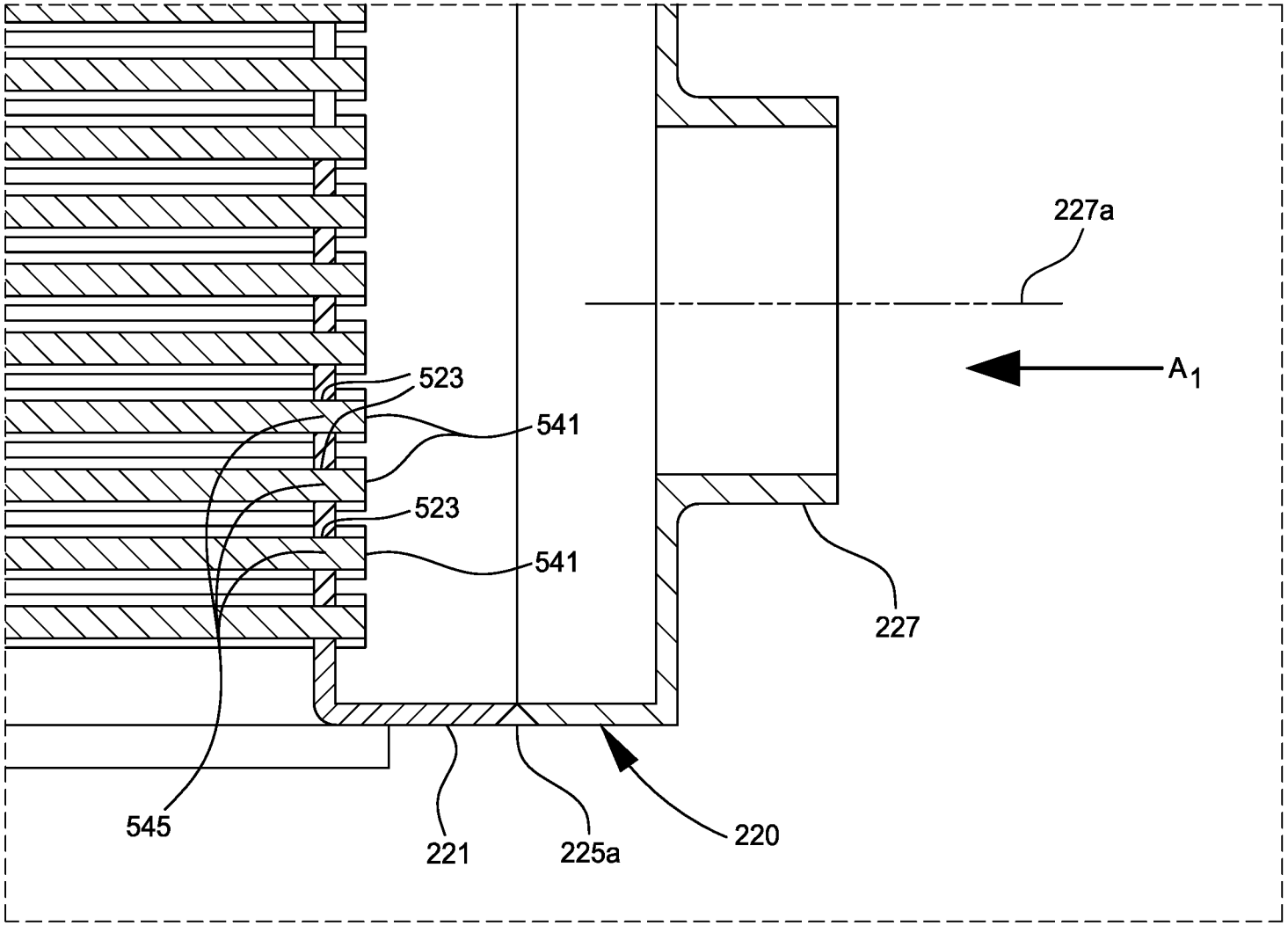
FIGS. 5B and 5C are partially-enlarged views of parts of FIG. 5A.
Figure 5C:
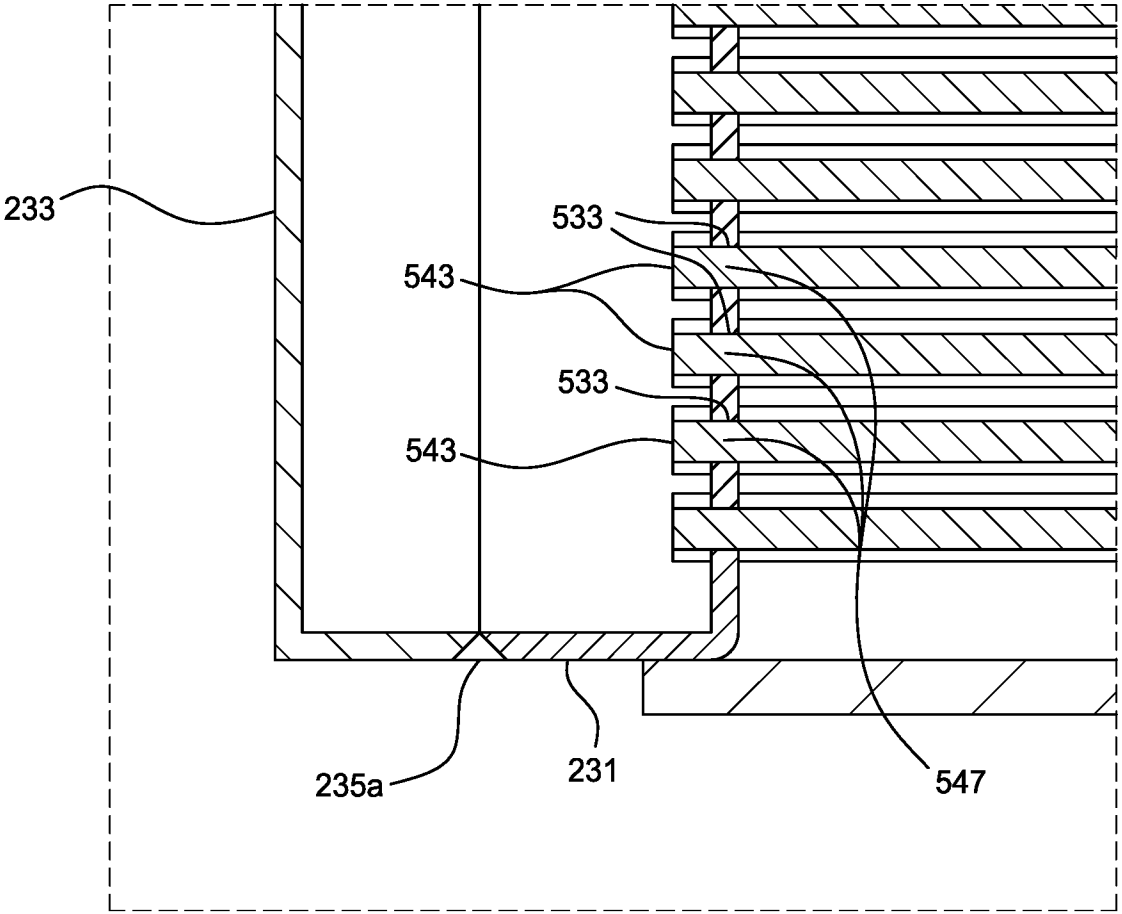

FIG. 5A is a cross-sectional schematic illustration of a heat exchanger core 210, taken along section 5-5 shown in FIG. 3 and FIG. 4A. FIGS. 5B and 5C are partially-enlarged views of parts of FIG. 5A. The curved channel frames 240 have first ends 541 and second ends 543. The first fluid is configured to flow in the through one or more fluid passageways (e.g. fluid passageways 410 shown in FIGS. 4A and 4B) in the first direction $A_1$ from the first ends 541 to the second ends 543. In some embodiments, at least one of the curved channel frames 240 includes a first length $L_1$ defined between the inlet header 221 and the outlet header 231. In some embodiments, at least one of the curved channel frames 240 include a second length $L_2$ defined between a first end 541 and a second end 543.

In some embodiments, at least one of the curved channel frames 240 has a cross section (shown as 414 in FIG. 4A) that is curved and substantially continuous throughout the first length $L_1$ of the curved channel frame 240, as illustrated in the embodiment of FIG. 5A. In some embodiments, at least one of the curved channel frames 240 has a cross section (shown as 414 in FIG. 4A) that is curved and substantially continuous throughout the second length $L_2$ of the curved channel frame 240, as illustrated in the embodiment of FIG. 5A.

The curved channel frames 240 may include inlet portions 545 adjacent to the first ends 541, and outlet portions 547 adjacent to the second ends 543. The curved channel frames 240 may also include middle portions 549 between the inlet portions 545 and the outlet portions 547. The inlet tank 220 includes the inlet header 221 disposed around the inlet portions 545 of the curved channel frames 240. The inlet tank also includes the inlet cover 223 welded to the inlet header 221, thereby defining a first welded joint 225. The outlet tank 230 includes the outlet header 231 disposed around the outlet portions 547 of the curved channel frames 240. The outlet tank 230 also includes the outlet cover 233 welded to the outlet header, thereby defining a second welded joint 235. The middle portions 549 of the curved channel frames 240 can be disposed between the inlet tank 220 and the outlet tank 230. In some embodiments, the heat exchanger core 210 may include channel frames that are not curved. In some embodiments, the first ends 541 and the second ends 543 are disposed between the first welded joint 225 and the second welded joint 235. The inlet tank 220 defines an inlet volume 520, and the outlet tank 230 defines an outlet volume 530. In some embodiments, the first ends 541 of the curved channel frames extend into the inlet volume 520. In some embodiments, the second ends 543 of the curved channel frames 240 extend into the outlet volume 530.

The inlet header 221 of the inlet tank 220 is brazed to the inlet portions 545 of the curved channel frames 240, thereby defining a first set of brazed joints 523. The outlet header 231 of the outlet tank 230 is brazed to the outlet portions 547 of the curved channel frames, thereby defining a first set of brazed joints 533. In some embodiments the first set of brazed joints 523 are disposed between the first welded joint 225 and the second welded joint 235. The first set of brazed joints 523 is disposed at a first distance $D_1$ from the first welded joint 225. In some embodiments, the first distance $D_1$ is at least about 15 mm. In some embodiments the second set of brazed joints 533 is disposed between the first welded joint 225 and the second welded joint 235. The second set of brazed joints 533 is disposed at a second distance $D_2$ from the second welded joint 235. In some embodiments, the second distance $D_2$ is at least about 15 mm.

Figure 6:
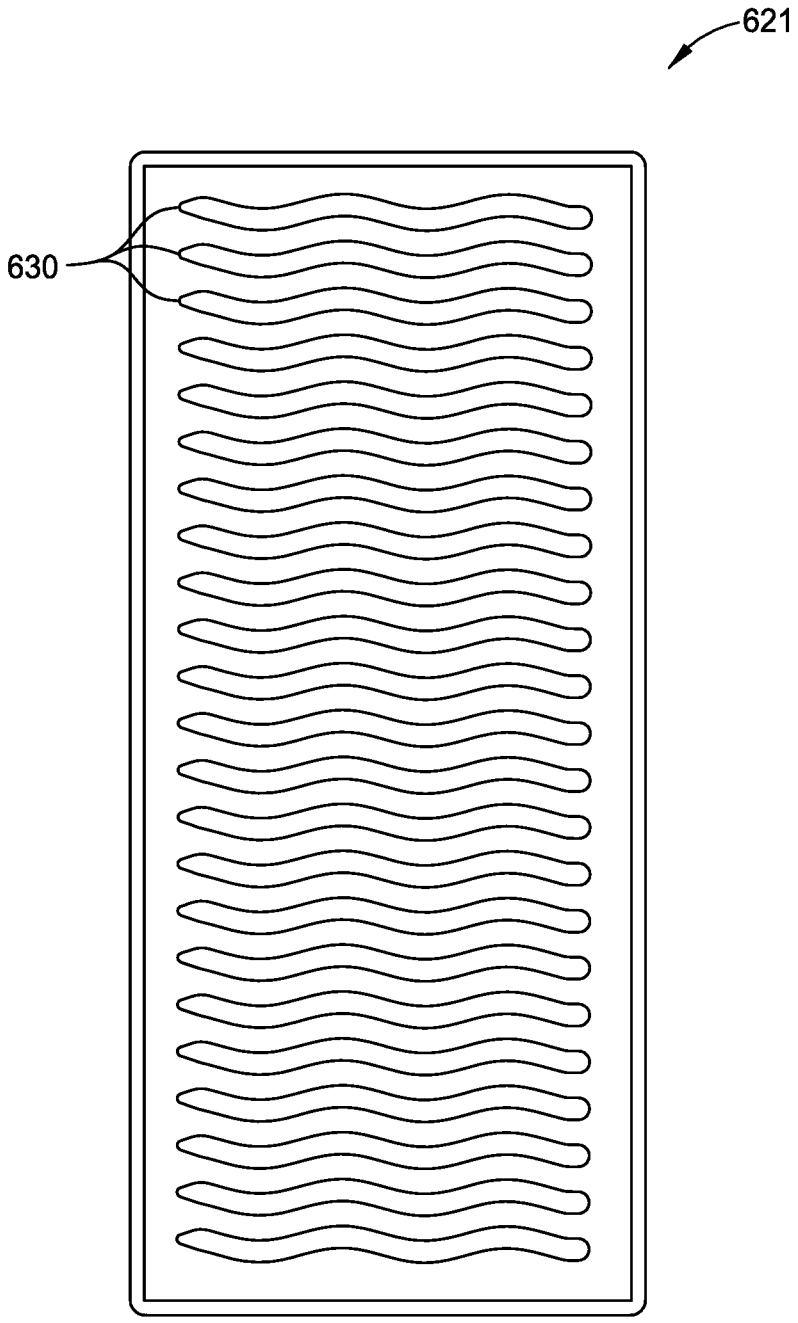
FIG. 6 is a side-view illustration of a header, according to one embodiment.

FIG. 6 is a side view of a header 621 that may be used as the inlet header 221 of the inlet tank 220 and/or the outlet header 231 of the outlet tank 230. The header 621 includes openings 630. The openings 630 are curved. In some embodiments, the openings 630 are configured to receive one or more channel frames. For example, in some embodiments, an opening is sized and shaped to receive the curved channel frames 240 illustrated in FIG. 4A.

Figure 7:
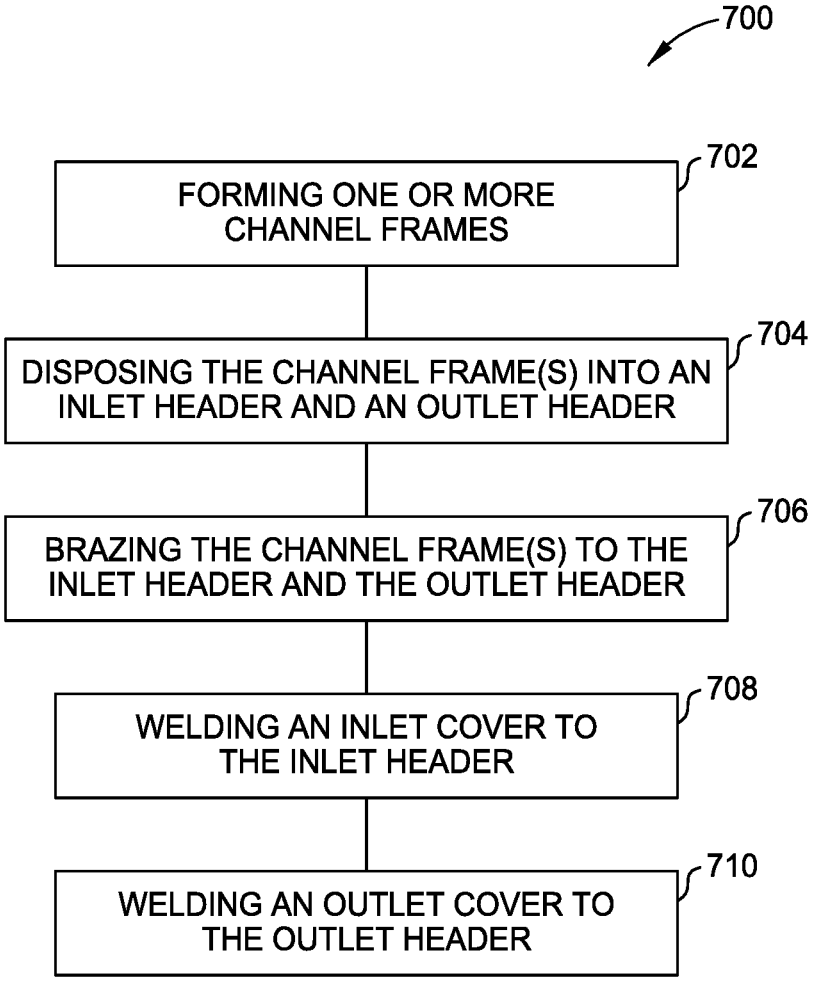
FIG. 7 is a schematic illustration of a method of manufacturing a heat exchanger core, according to one embodiment.

FIG. 7 is a schematic illustration of a method 700 of manufacturing a heat exchanger core. At operation 702, one or more channel frames, such as curved channel frames 240, are formed. Each of the one or more channel frames has a first end, a second end, an inlet portion adjacent to the first end, and an outlet portion adjacent to the second end. The one or more channel frames are disposed into an inlet header and an outlet header at operation 704. In some embodiments, the channel frames are disposed such that the first end of each of the one or more channel frames is received in a corresponding opening in the inlet header, and the second end of the one or more channel frames is received in a corresponding opening in the outlet header. The channel frames are brazed to the inlet header and the outlet header at operation 706. The brazing forms a first set of one or more brazed joints adjacent to the inlet header and a second set of one or more brazed joints adjacent to the outlet header.

In some embodiments, the brazing performed at operation 706 includes placing the one or more channel frames, the inlet header, and the outlet header into an oven. In some embodiments, the brazing performed at operation 706 includes exposing the one or more channel frames, the inlet header, and the outlet header to a temperature that is at least about 500 degrees Celsius. In some embodiments, the brazing performed at operation 706 includes exposing the one or more channel frames, the inlet header, and the outlet header to a temperature that is at or above a melting temperature of a braze material. In one example, the temperature is below the melting temperature of a base material. In one example, the base material includes one or more of a material of the one or more channel frames, a material of the inlet header, and/or a material of the outlet header.

At operation 708, an inlet cover is welded to the inlet header. In some embodiments, welding the inlet cover to the inlet header forms an inlet tank that defines an inlet volume. At operation 710, an outlet cover is welded to the outlet header. In some embodiments, welding the outlet cover to the outlet header forms an outlet tank that defines an outlet volume. In some embodiments, welding at operations 708 and/or 710 is performed using one or more of tungsten inert gas (TIG) welding, metal inert gas (MIG) welding, laser welding, friction stir welding (FSW), and/or plasma welding. For example, in some embodiments, the inlet cover is welded to the inlet header in operation 708 using one or more of tungsten inert gas (TIG) welding, metal inert gas (MIG) welding, laser welding, friction stir welding (FSW), and/or plasma welding.

In some embodiments, welding the inlet cover to the inlet header at operation 708 is performed at a distance of at least about 15 mm from the first set of one or more brazed joints. In some embodiments, welding the outlet cover to the outlet header at operation 710 is performed at a distance of at least about 15 mm from the second set of one or more brazed joints. By controlling the distance of welding from a set of one or more brazed joints, the extent of damage to the one or more brazed joints is reduced or removed.

It will be appreciated by those skilled in the art that the preceding embodiments are exemplary and not limiting. It is intended that all modifications, permutations, enhancements, equivalents, and improvements thereto that are apparent to those skilled in the art upon a reading of the specification and a study of the drawings are included within the scope of the disclosure. It is therefore intended that the following appended claims may include all such modifications, permutations, enhancements, equivalents, and improvements.

The invention claimed is:

1. A heat exchanger core, comprising:

an inlet header;

an outlet header; and one or more curved channel frames disposed at least partially between the inlet header and the outlet header, each of the one or more curved channel frames having a first end and a second end, each of the one or more curved channel frames having a plurality of fluid passageways formed in a cross section of the respective curved channel frame that each direct flow of a first fluid in a first direction therethrough from the first end to the second end, and each of the one or more curved channel frames defining a sinusoidal profile in a direction that is perpendicular to the first direction, the sinusoidal profile having one or more crests and one or more troughs;

wherein one or more of the one or more curved channel frames includes a rounded leading edge and a tapered trailing edge; and wherein the plurality of fluid passageways are disposed and separated from each other along the sinusoidal profile, each of the plurality of fluid passageways is defined on all sides by a plurality of inner walls of the respective curved channel frame, the plurality of inner walls comprises an upper inner wall and a lower inner wall, and each of the upper inner wall and the lower inner wall is curved to be parallel to the sinusoidal profile.

2. The heat exchanger core of claim 1, wherein the rounded leading edge has a radius within a range of about 1 mm to about 4 mm.

3. The heat exchanger core of claim 1, wherein the tapered trailing edge has a taper angle within a range of about 10 degrees to about 60 degrees.

4. The heat exchanger core of claim 1, wherein each of the plurality of fluid passageways of each of the one or more curved channel frames are configured to withstand a temperature of the first fluid that is within a range of about −50 degrees Celsius to about 300 degrees Celsius.

5. The heat exchanger core of claim 1, wherein the one or more curved channel frames are disposed at a frame density along a length in the heat exchanger core, the frame density being within a range of about 0.5 curved channel frames per inch to about 6 curved channel frames per inch.

6. The heat exchanger core of claim 1, wherein the heat exchanger core comprises two or more curved channel frames, and the two or more curved channel frames are spaced from each other by a distance within a range of about 1 mm to about 30 mm.

7. The heat exchanger core of claim 1, wherein the sinusoidal profile has an amplitude of about 1 mm to about 10 mm.

8. The heat exchanger core of claim 1, wherein the one or more crests and the one or more troughs are disposed at a peak density along a length, the peak density being within a range of about 1 peak per inch to about 8 peaks per inch.

9. A heat exchanger core, comprising:

an inlet header;

an outlet header; and one or more curved channel frames disposed at least partially between the inlet header and the outlet header, each of the one or more curved channel frames having a first end and a second end, each of the one or more curved channel frames having a plurality of fluid passageways formed in a cross section of the respective curved channel frame that each flow a first fluid in a first direction therethrough from the first end to the second end, and each of the one or more curved channel frames defining a sinusoidal profile in a direction that is perpendicular to the first direction, the sinusoidal profile having one or more crests and one or more troughs;

wherein at least one of the one or more curved channel frames has the cross section and a first length defined between the inlet header and the outlet header; and wherein the cross section is curved and-substantially continuous throughout the first length; and wherein the plurality of fluid passageways are disposed and separated from each other along the sinusoidal profile, each of the plurality of fluid passageways is defined on all sides by a plurality of inner walls of the respective curved channel frame, the plurality of inner walls comprises an upper inner wall and a lower inner wall, and each of the upper inner wall and the lower inner wall is curved to be parallel to the sinusoidal profile.

10. The heat exchanger core of claim 9, wherein the first end and the second end of each of the one or more curved channel frames define a second length therebetween, and the cross section of at least one of the one or more curved channel frames is curved and substantially continuous throughout the second length.

11. The heat exchanger core of claim 9, wherein the sinusoidal profile has an amplitude of about 1 mm to about 10 mm.

12. The heat exchanger core of claim 9, wherein the one or more crests and the one or more troughs are disposed at a peak density along a length, the peak density being within a range of about 1 peak per inch to about 8 peaks per inch.

13. A heat exchanger core, comprising:

one or more curved channel frames, each of the one or more curved channel frames having a first end, a second end, an inlet portion adjacent to the first end, and an outlet portion adjacent to the second end;

a plurality of fluid passageways formed in a cross section of one of the one or more curved channel frames that each direct flow of a first fluid in a first direction therethrough from the first end to the second end, wherein each of the one or more curved channel frames defines a sinusoidal profile in a direction that is perpendicular to the first direction, the sinusoidal profile having one or more crests and one or more troughs, the plurality of fluid passageways are disposed and separated from each other along the sinusoidal profile, each of the plurality of fluid passageways is defined on all sides by a plurality of inner walls of the respective one of the one or more curved channel frames, the plurality of inner walls comprises an upper inner wall and a lower inner wall, and each of the upper inner wall and the lower inner wall is curved to be parallel to the sinusoidal profile;

an inlet tank, comprising:

an inlet header disposed around the inlet portion of each of the one or more curved channel frames, and an inlet cover welded to the inlet header, thereby defining a first welded joint;

an outlet tank, comprising:

an outlet header disposed around the outlet portion of each of the one or more curved channel frames; and an outlet cover welded to the outlet header, thereby defining a second welded joint.

14. The heat exchanger core of claim 13, wherein the first end and the second end of each of the one or more curved channel frames are both disposed between the first welded joint and the second welded joint.

15. The heat exchanger core of claim 13, wherein the inlet header is brazed to the inlet portion of each of the one or more curved channel frames thereby defining a first set of one or more brazed joints, and the outlet header is brazed to the outlet portion of each of the one or more curved channel frames thereby defining a second set of one or more brazed joints; and wherein the first set of one or more brazed joints and the second set of one or more brazed joints are both disposed between the first welded joint and the second welded joint.

16. The heat exchanger core of claim 13, wherein the first end of each of the one or more curved channel frames extends into an inlet volume defined by the inlet tank, and the second end of each of the one or more curved channel frames extends into an outlet volume defined by the outlet tank.

17. A method of manufacturing a heat exchanger core, comprising:

forming one or more curved channel frames, each of the one or more curved channel frames having a first end, a second end, an inlet portion adjacent to the first end, and an outlet portion adjacent to the second end, each of the one or more curved channel frames having a plurality of fluid passageways formed in a cross section of the respective curved channel frame that each direct flow of a first fluid in a first direction therethrough from the first end to the second end, and each of the one or more curved channel frames defining a sinusoidal profile in a direction that is perpendicular to the first direction, the sinusoidal profile having one or more crests and one or more troughs, wherein the plurality of fluid passageways are disposed and separated from each other along the sinusoidal profile, each of the plurality of fluid passageways is defined on all sides by a plurality of inner walls of the respective curved channel frame, the plurality of inner walls comprises an upper inner wall and a lower inner wall, and each of the upper inner wall and the lower inner wall is curved to be parallel to the sinusoidal profile;

disposing each of the one or more curved channel frames into an inlet header and an outlet header such that the first end of each of the one or more curved channel frames is received in a corresponding opening in the inlet header, and the second end of the one or more curved channel frames is received in a corresponding opening in the outlet header;

brazing the one or more curved channel frames to the inlet header and the outlet header, thereby forming a first set of one or more brazed joints adjacent to the inlet header and a second set of one or more brazed joints adjacent to the outlet header;

welding an inlet cover to the inlet header, thereby forming an inlet tank that defines an inlet volume; and welding an outlet cover to the outlet header, thereby forming an outlet tank that defines an outlet volume.

18. The method of claim 17, wherein welding the inlet cover to the inlet header is performed using one or more of tungsten inert gas (TIG) welding, metal inert gas (MIG) welding, laser welding, friction stir welding (FSW), or plasma welding.

19. The method of claim 17, wherein welding the inlet cover to the inlet header is performed at a distance of at least about 15 mm from the first set of one or more brazed joints.

20. The method of claim 17, wherein brazing the one or more curved channel frames to the inlet header and the outlet header comprises placing the one or more curved channel frames, the inlet header, and the outlet header into an oven.

21. The method of claim 17, wherein brazing the one or more curved channel frames to the inlet header and the outlet header comprises exposing the one or more curved channel frames, the inlet header, and the outlet header to a temperature that is at or above a melting temperature of a braze material.

* * * * *